US005342175A

United States Patent [19]

Patton

[11] Patent Number: 5,342,175

[45] Date of Patent: Aug. 30, 1994

[54] GRILL

[75] Inventor: Noel T. Patton, Hong Kong, Hong Kong

[73] Assignee: Patton Electric Company, Inc., New Haven, Ind.

[21] Appl. No.: 37,038

[22] Filed: Mar. 25, 1993

[51] Int. Cl.[5] ..... F04D 29/70

[52] U.S. Cl. ..... 416/247 R; 415/121.2

[58] Field of Search ..... 416/247 R; 415/121.2, 415/211.2; 392/368, 374, 365; D23/412, 335, 328, 354, 381, 382, 370

[56] References Cited

U.S. PATENT DOCUMENTS

| | | | |
|---|---|---|---|
| D. 119,197 | 2/1940 | MacFadden et al. | D23/335 |
| D. 173,550 | 11/1954 | Wrablica, Jr. . | |
| D. 291,350 | 8/1987 | Sherman et al. . | |
| D. 294,633 | 3/1988 | McBratney . | |
| D. 300,847 | 4/1989 | Lin . | |
| D. 305,260 | 12/1989 | Mito | D23/337 |
| D. 309,182 | 7/1990 | Hsu . | |
| D. 312,124 | 11/1990 | Coup et al. . | |
| D. 318,526 | 7/1991 | Chaney . | |
| D. 323,708 | 2/1992 | Wang . | |
| D. 324,907 | 3/1992 | Cook . | |
| 2,100,439 | 11/1937 | Friedman . | |
| 3,725,640 | 4/1973 | Kunz | 415/121.2 |

FOREIGN PATENT DOCUMENTS 208455 9/1986 Japan .

OTHER PUBLICATIONS

Bell & Co., Catalog, 1960, p. 247, Heater A, middle right side of page.

Sun Radio Co., Advertisement brochure, inside page, Thermo-Cool Unit A, top left side of page.

*Primary Examiner*—Edward K. Look
*Assistant Examiner*—James A. Larson
*Attorney, Agent, or Firm*—George Pappas

[57] ABSTRACT

A grill for appliances such as, for example, portable electric fans, heaters, humidifiers, radios, etc. The grill may be used to prevent individuals from touching the appliance's internal components while, nevertheless, allowing movement of air and sound therethrough and/or merely for decorative purposes. The grill is made up of a plurality of elongate ribs spaced apart from each other and which define a plurality of slots therebetween. Each rib is shaped having a central peak extending upwardly from side portions located on the right and left sides of the central peak. The central peak and the side portions are connected together via a curvilinear region and, thus, each of the ribs generally have a bell-shape. The ribs each have an outer surface that is coplanar with the fan/heater unit front surface and, thus, define a flat plane outer surface. The flat plane outer surface, in perspective, appears to have depth beyond the flat plane surface.

18 Claims, 4 Drawing Sheets

GRILL

TECHNICAL FIELD

The present invention relates to the technical field of grills for use on appliances such as, for example, fans, heaters, humidifiers, and radios. More specifically, the present invention relates to a grill that has a flat plane outer surface and yet appears to the ordinary observer as having depth beyond the flat plane outer surface. The grill can be used to protect an individual and prevent access to components of the appliance and/or merely for decorative purposes.

BACKGROUND OF THE INVENTION

Appliances such as portable fans, heaters, radios, etc., are normally manufactured with a protective grill which serves to prevent an individual from coming in contact with the internal appliance components while, nevertheless, providing openings for the moving air or sound to travel therethrough. Protective grills for fans and heaters were initially made of materials such as steel, brass, wood etc. These materials are formed into wire and/or otherwise bent and formed so as to form a protective grill that is sturdy and pleasing in appearance. Passages are formed inbetween the formed materials that are sufficiently large to allow the free movement of air and/or sound. Nevertheless, the passages effectively prevent someone handling the appliance from inadvertently inserting their fingers therethrough. An example of a grill used as a fan blade protective grill and made of steel wire is shown in U.S. Pat. No. Des. 173,550.

More recently, most protective grills have been manufactured with plastic materials and formed by injection molding methods. These grills normally have plastic ribs that serve the same purpose as the formed materials and wire in the prior grills. The injection molded plastic protective grills are also generally inexpensive to manufacture and function sufficiently well for their intended purpose. Examples of such plastic protective grills are shown in U.S. Pat. No. Des. 300,847, U.S. Pat. No. 324,907 and Design U.S. Pat. No. 323,708.

Substantial time and expense, however, is required for producing the tooling used during the injection molding process for forming the protective grills. In addition, the more aesthetically pleasing three-dimensional protective grills are complex and intricate and require complex and intricate tooling. As can be appreciated, although the aesthetically pleasing three-dimensional shaped protective grills are more desirable, the tooling therefor requires more time to manufacture and are generally more expensive than the tooling for simpler two-dimensional or single plane protective grills.

Accordingly, a need exists for a protective grill that may be manufactured by injection molding and which is both functional for its intended purpose and aesthetically pleasing. Furthermore, a need exists for a protective grill having the appearance of three dimensions but having the lower tooling costs involved in producing two-dimensional or single plane protective grills.

SUMMARY OF THE INVENTION

It is the principal object of the present invention to overcome the above-discussed disadvantages associated with prior fan blade protective grills used on appliances such as, for example, fans, heaters, humidifiers, radios and other air moving appliances.

The present invention overcomes the disadvantages associated with prior protective grills by providing a protective grill structure having a flat plane outer surface but which, nevertheless, creates an appearance to the ordinary observer of having depth beyond the flat plane outer surface. This is accomplished by providing a grill made up of a plurality of elongate grill ribs spaced apart from each other and defining a plurality of slots therebetween. These slots can extend through the grill and serve as air and/or sound passages. Each of the ribs are in a single flat plane and have an outer surface that together define the grill flat plane outer surface. As viewed from the front and looking at the rib outer surfaces, the ribs are shaped with a central peak extending upwardly from side portions located on the right and left sides of the peak. The central peak and the side portions are connected together by smooth curvilinear regions. Each rib is, thus, shaped similar to a bell and is located in a flat plane. However, although the outer surface is a flat plane, to the ordinary observer viewing the same from a slight angle, the grill appears to have three dimensional depth beyond the flat plane outer surface.

When the protective grill is used on a portable fan/-heater, the protective grill flat plane outer surface is located perpendicular to the air flow longitudinal axis. The grill ribs are preferably quadrangle-shaped in cross section and, for decreasing material costs and decreasing the thickness of the grill ribs, one or more elongate support ribs are preferably provided and are attached to the top and bottom of the grill structure and to the grill ribs. The support ribs are affixed to the back side of the grill ribs opposite the outer surface and act to support the grill ribs. The flat plane protective grill and quadrangle-shaped ribs effectively lend themselves to generally inexpensive injection molding processes and the protective grill is preferably thus made of a plastic material.

So as to best accomplish the appearance of depth, the grill ribs are bell-shaped as described. Preferably, the side portions are straight and the curvilinear regions on both the left and right sides of the central peak are mirror images of one another. In addition, when the protective grill is used on a portable fan/heater unit, the protective grill flat plane outer surface extends across the entire fan/heater unit front face such that the rib straight portions extend to the left and right sides of the fan/heater unit.

In one form thereof, the present invention is directed to a protective grill having a flat plane outer surface giving the appearance of having depth beyond the flat plane outer surface. The protective grill includes a plurality of elongate ribs spaced apart from each other and defining a plurality of air passage slots therebetween. Each of the ribs have an outer surface defining the grill flat plane outer surface and are shaped with a central peak extending upwardly from straight portions located on the right and left sides of the central peak. The central peak and straight portions are connected together via curvilinear regions.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

Figure 1:
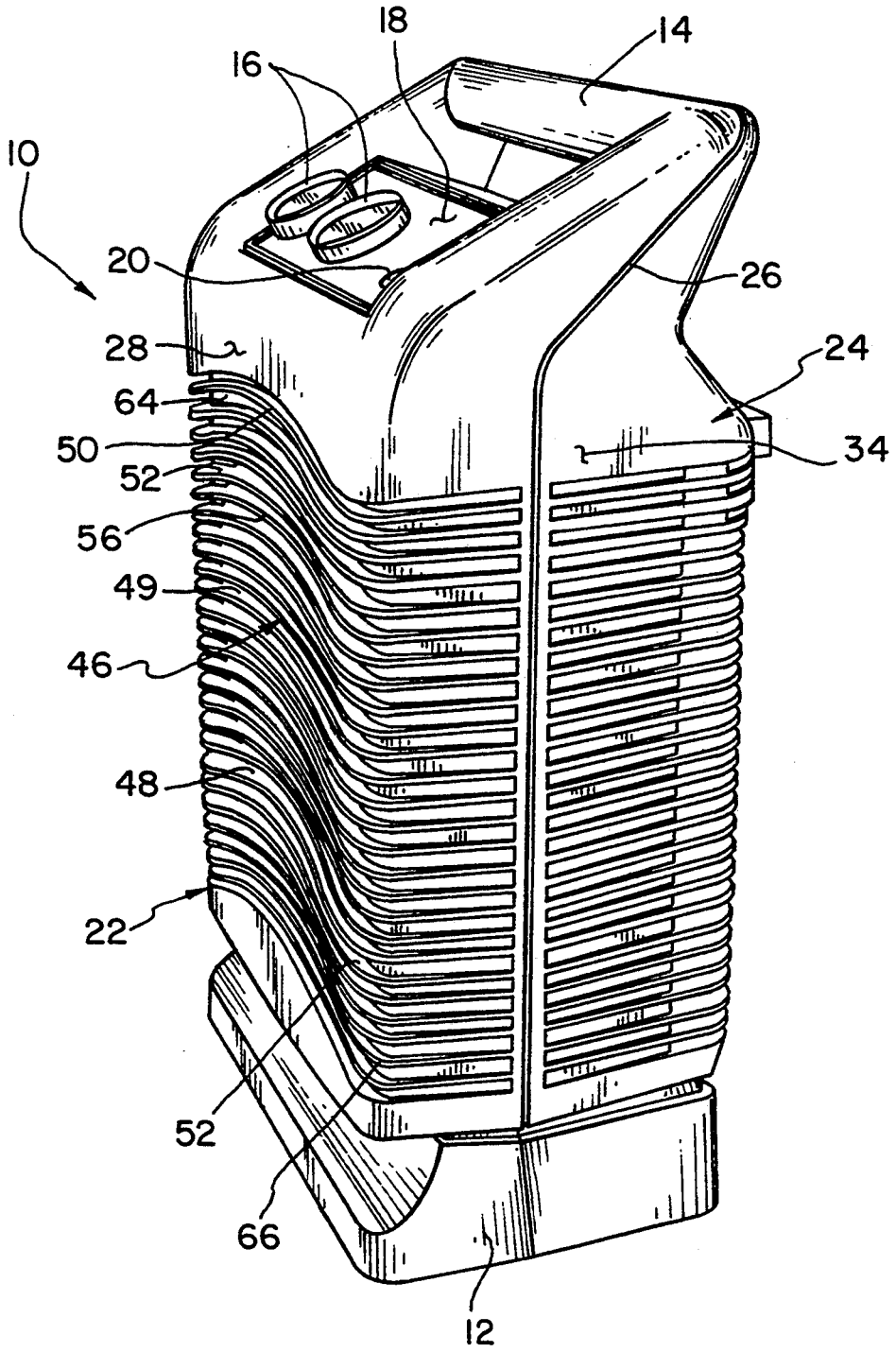
FIG. 1 is a perspective view of a fan/heater unit incorporating the protective grill according to the present invention with the appearance of having depth beyond the flat plane grill front surface.

The exemplifications set out herein illustrate preferred embodiments of the invention in one form thereof and such exemplifications are not to be construed as limiting the scope of the disclosure or the scope of the invention in any manner.

DETAILED DESCRIPTION OF A PREFERRED EMBODIMENT

Referring to the drawings, there is shown a portable electric fan/heater unit designated generally by the numeral 10. Portable fan/heater 10 includes a base 12, carrying handle 14 and control knobs 16 on control panel 18. Control knobs 16 are wired in a known and customary manner for energizing and de-energizing fan/heater 10. A light 20 is also provided on control panel 18 for indicating the mode of operation of fan/-heater 10.

The fan/heater housing is made of a front panel 22 and a back panel 24 which are joined together as shown along seam 26. Both front and back panels 22 and 24 are made of a plastic material and are formed by injection molding. Panels 22 and 24, thus, also form the fan/-heater housing front face 28, back face 30, left side face 32 and right side face 34. Preferably, front panel 22 is injection molded with an integral cylindrical air duct 36. The longitudinal axis of air duct 36 and, thus, the cylindrical air duct itself is situated perpendicular to front face 28 as more clearly shown in FIG. 4.

Fan/heater 10 includes an electric motor 38 adapted for driving fan blades 40. The fan/heater 10 further includes a filter element 42 along the back face 30 for filtering air drawn through the fan/heater unit 10. Electric heating elements 44 are provided for creating controlled heat and selectively providing heat via the fan/-heater unit 10. Thus, in the present embodiment, air is drawn through an intake opening on the back face 30, through filter elements 42, over heating elements 44, and through air duct 36 and out through the front face fan blade protective grill generally designated by the numeral 46.

Figure 2:
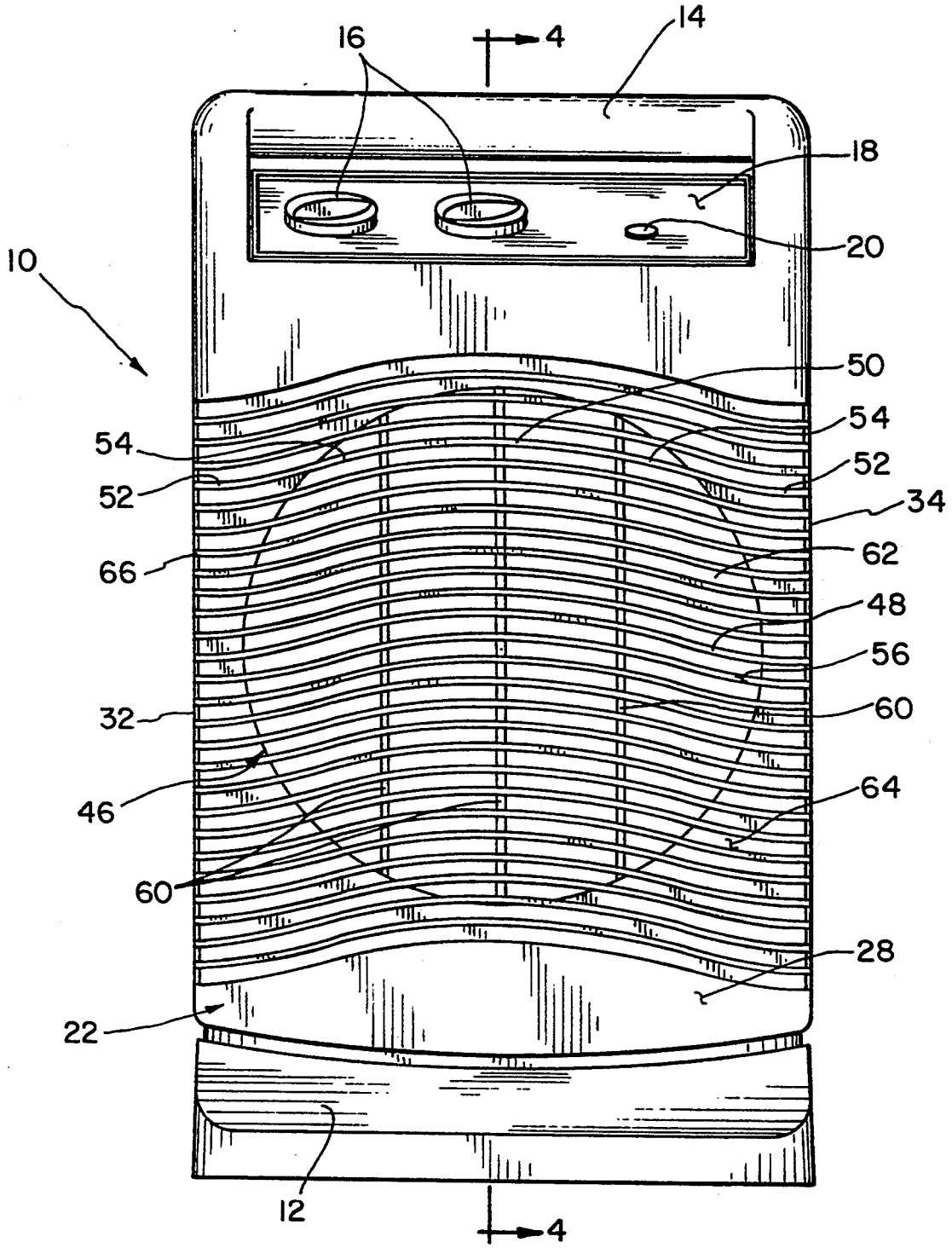
FIG. 2 is a front elevational view of the fan/heater unit and protective grill shown in FIG. 1.
Figure 3:
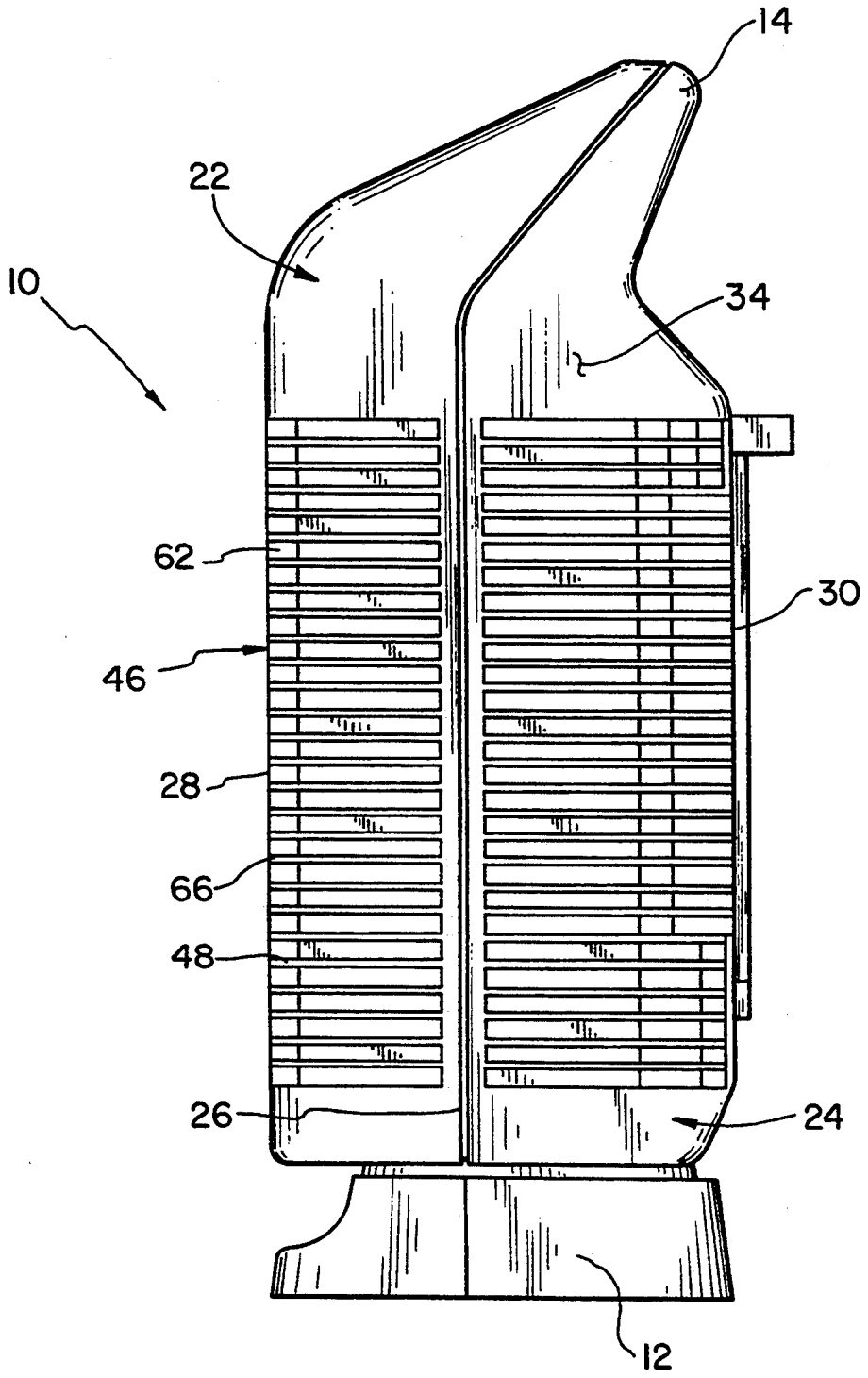
FIG. 3 is a side elevational view of the fan/heater shown in FIG. 1.

Fan blade protective grill 46, which is constructed according to the present invention, lies in a flat plane and is made up of a plurality of grill ribs 48. Grill ribs 48 extend across the front face 28 of fan/heater unit 10 from left side face 32 to right side face 34. As best seen in FIG. 2, ribs 48 are shaped having a central peak 50 integrally connected on both the left and right sides thereof to portions 52 which are shown in this preferred embodiment as being straight. Straight portions 52 and the central peak area are connected via curvilinear regions 54. Thus, as viewed in FIG. 2, grill ribs 48 form a bell-shaped curve and, when viewed in perspective as shown in FIG. 1, appear to the normal observer as having depth toward the inside of the fan/heater unit 10. Preferably, as shown in FIG. 2, straight portions 52 and curvilinear regions 54 on the left and right sides of central peak 50 are mirror images of one another.

Figure 4:
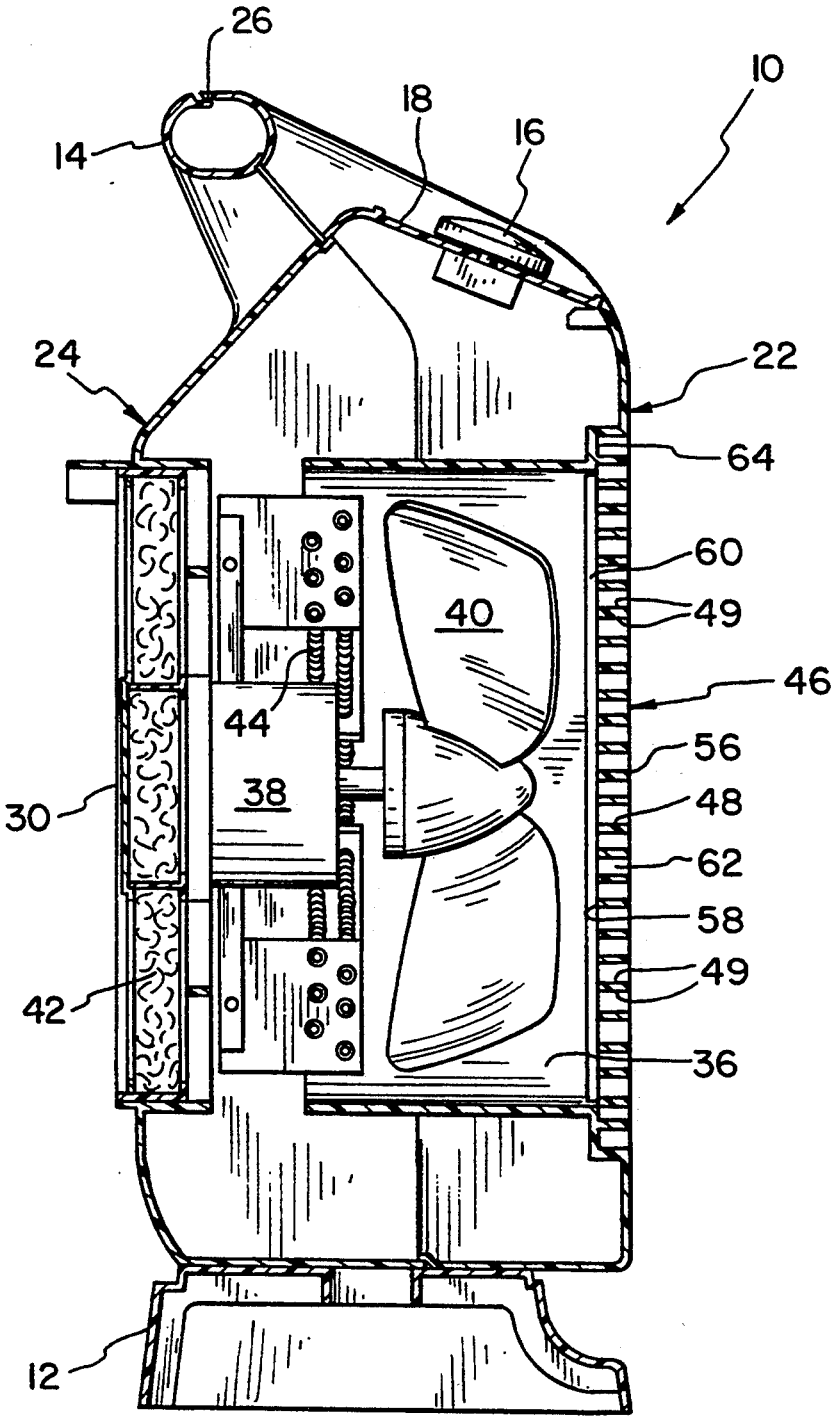
FIG. 4 is a cross-sectional view of the fan/heater and protective grill taken along line 4—4 in FIG. 2.

As best seen in FIG. 4, each of ribs 48 are rectangular in cross-section. Although a rectangular cross-section as shown is preferred, it is noted that any quadrangle shape could be used for achieving the same results. It is noted, however, that a rectangular cross-section shape with the rectangle longest length faces 49 being horizontal and, thus, also perpendicular to the protective grill 46, front face 28 has been found to best achieve the depth illusion. Grill ribs 48 have a front face 56 that, in essence, define a portion of the flat plane outer surface front face 28 of fan/heater 10.

On the back surface 58 of ribs 48 there are preferably integrally attached a plurality of support ribs 60. Support ribs 60, as best seen in FIGS. 2 and 4, extend generally vertically and are integrally attached to each of the grill ribs 48 extending across cylindrical air duct 36. Preferably, support ribs 60 are also attached to air duct 36. As can be appreciated, support ribs 60 stabilize and support grill ribs 48.

As seen in FIG. 2, ribs 48 extending across air duct 36 define air passage slots 62 therebetween for allowing air being pushed by fan blades 40 to travel therethrough. Radially outside of air duct 36, grill ribs 48 are attached to and extend away from a back rib wall 64. Air passage slots 62, thus, appear to be present inbetween ribs 48 across the entire portion of front face 28 making up protective grill 46 and along the full length of ribs 48. Accordingly, in the present application, air passage slots 62 are defined and mean a slot located between ribs 48 whether or not, in fact, openings exist wherethrough air pushed by fan blades 40 is caused to travel therethrough.

In the present embodiment, as shown, rib straight portions 52 terminate at the right and left side faces 32 and 34 and, at that juncture, are provided with a rounded nose 66 wrapping around to left and right side faces 32 and 34.

While the invention has been described as having specific embodiments, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A grill having a flat plane outer surface giving the appearance of having depth beyond the flat plane outer surface, said grill comprising a plurality of elongate ribs spaced apart from each other and defining a plurality of slots therebetween, each of said ribs having an outer surface defining said grill flat plane outer surface and wherein each of said ribs are similarly shaped with a peak extending upwardly from portions located on the right and left sides of said peak, said peak and portions below said peak connected via curvilinear regions and, wherein said rib portions are substantially straight and said peak is centered therebetween, said curvilinear regions on the left and right sides of said central peak being mirror images of one another.

2. The grill of claim 1 wherein said slots extend through said grill and define air passages and further comprising a cylindrical air duct having a longitudinal axis extending between a fan and said grill, said grill flat plane outer surface being generally perpendicular to the air duct longitudinal axis.

3. The grill of claim 2 further comprising an elongate support rib attached to said cylindrical air duct and to said grill ribs, whereby said grill ribs are supported.

4. The grill of claim 3 wherein said grill ribs are quadrangle-shaped in cross-section.

5. The grill of claim 2 wherein said grill and said air duct are made of plastic and are formed by injection molding.

6. The grill of claim 2 wherein said grill flat plane outer surface extends across a fan unit front face and said rib portions extend to a left and right side of said fan unit.

7. The grill of claim 2 wherein said grill ribs are quadrangle-shaped in cross section.

8. The grill of claim 1 further comprising an elongate support rib attached to said grill ribs, whereby said grill ribs are supported.

9. The grill of claim 1 wherein said grill ribs are quadrangle-shaped in cross-section.

10. The grill of claim 1 wherein said grill ribs are made of plastic and are formed by injection molding.

11. The grill of claim 1 wherein said grill flat plane outer surface extends across a fan unit front face and said rib portions extend to a left and right side of said fan unit.

12. The grill of claim 11 further comprising an elongate support rib attached to said grill ribs, whereby said grill ribs are supported.

13. The protective grill of claim 11 wherein said grill ribs are quadrangle-shaped in cross-section,

14. The grill of claim 1 wherein said grill ribs are rectangle-shaped in cross-section.

15. A grill having a flat plane outer surface giving the appearance of having depth beyond the flat plane outer surface, said grill comprising a plurality of elongate ribs spaced apart from each other and defining a plurality of slots therebetween, each of said ribs having an outer surface defining said grill flat plane outer surface and shaped with a peak extending upwardly from portions located on the right and left sides of said peak, said peak and portions below said peak connected via curvilinear regions and, wherein said rib portions are substantially straight and said peak is centered therebetween, said curvilinear regions on the left and right sides of said central peak being mirror images of one another.

16. The grill of claim 15 further comprising an elongate support rib attached to said grill ribs, whereby said grill ribs are supported.

17. The grill of claim 15 wherein said grill ribs are quadrangle-shaped in cross-section.

18. A grill having a flat plane outer surface giving the appearance of having depth beyond the flat plane outer surface, said grill comprising a plurality of elongate ribs spaced apart from each other and defining a plurality of slots therebetween, each of said ribs having an outer surface defining said grill flat plane outer surface and shaped with a peak extending upwardly from portions located on the right and left sides of said peak, said peak and portions below said peak connected via curvilinear regions and, wherein said grill flat plane outer surface extends across a fan unit from face and said rib portions extend to a left and right side of said fan unit, said rib portions being substantially straight and said peak centered therebetween, said curvilinear regions on the left and right sides of said central peak being mirror images of one another.

* * * * *